US006319150B1

(12) United States Patent
Werner et al.

(10) Patent No.: US 6,319,150 B1
(45) Date of Patent: Nov. 20, 2001

(54) FACE STRUCTURE FOR GOLF CLUB

(75) Inventors: Frank D. Werner, P.O. Box SR9, Jackson, WY (US) 83001; Richard C. Greig, Jackson, WY (US)

(73) Assignee: Frank D. Werner, Teton Village, WY (US)

( * ) Notice: Subject to any disclaimer, the term of this patent is extended or adjusted under 35 U.S.C. 154(b) by 0 days.

(21) Appl. No.: 09/318,082

(22) Filed: May 25, 1999

(51) Int. Cl.[7] ..... A63B 53/04; A63B 53/06
(52) U.S. Cl. ..... 473/349; 473/324; 473/342
(58) Field of Search ..... 473/332, 329, 473/342, 346, 349, 350, 324

(56) References Cited

U.S. PATENT DOCUMENTS

| | | | |
|---|---|---|---|
| Re. 34,925 | | 5/1995 | McKeighen . |
| 664,438 | | 12/1900 | Sargent . |
| 4,076,254 | | 2/1978 | Nygren . |
| 4,930,781 | | 6/1990 | Allen . |
| 5,163,682 | | 11/1992 | Schmidt et al. . |
| 5,301,941 | * | 4/1994 | Allen ..... 273/167 |
| 5,318,300 | | 6/1994 | Schmidt et al. . |
| 5,366,223 | | 11/1994 | Werner et al. . |
| 5,380,010 | | 1/1995 | Werner et al. . |
| 5,464,211 | | 11/1995 | Atkins et al. . |
| 5,474,296 | | 12/1995 | Schmidt et al. . |
| 5,570,886 | | 11/1996 | Rigal et al. . |
| 5,830,084 | * | 11/1998 | Kosmatka ..... 473/349 |
| 5,921,871 | * | 7/1999 | Fisher ..... 473/329 |

* cited by examiner

*Primary Examiner*—Jeanette Chapman
*Assistant Examiner*—Sneh Varma
(74) *Attorney, Agent, or Firm*—Westman, Champlin & Kelly, P.A.

(57) ABSTRACT

A face wall for the hitting face of a golf club head is supported on a hollow structural shell. The face wall is formed to realize maximum face strength with minimum face mass. This is accomplished by varying the thickness of the face wall so it is thickest in the general vicinity of the face center and becomes thinner toward the edges of the face. This allows the club head to weigh less, incorporate a large face area and adequate strength while maintaining high moments of inertia of the head.

11 Claims, 6 Drawing Sheets

FACE STRUCTURE FOR GOLF CLUB

BACKGROUND OF THE INVENTION

The present invention relates to a new construction for the face wall of a golf club head.

Nearly all modern, popular heads called "woods", such as the driver and the fairway woods, are in the form of hollow shells, usually of metal. Driver heads must not weigh more than about 210 grams, or there is an unacceptable penalty in maximum distance of drives. The present inventors have done research which indicates that for maximum drive distance, optimum head mass may be as small as 180 grams and the shaft may be longer than usual. This finding is in reasonable agreement with modern trends in driver design. In addition, a large face is highly desirable because it strongly reduces the percentage of hits which are partly off the face (which the present inventors call POF hits). The present inventors have found that large faces are especially important because these POF hits are usually the worst hits a golfer makes. Large moments of inertia of the club head about its center of gravity are also highly desirable because they reduce errors caused by hits which are somewhat off center. Large size correlates closely with large moments of inertia, because this puts mass farther from the center of gravity.

These considerations bring about a design limitation in the maximum size of face which will have adequate strength for withstanding impact of club head and ball. The present invention respects this limitation, while concurrently allowing club heads to have larger faces.

FIG. 1 (prior art) shows an elevation view of a common design of bridge trusses for illustrative purposes. Supports are indicated at numeral 10 at the ends. At mid-span, the truss is often deeper (thicker) than at the supports as indicated at 12 to accommodate the greater bending stresses in this region. This has limited similarity to the construction of the face wall in the present invention. Such configurations have not been used in connection with golf club faces in the years during which hollow club head construction has been favored. There are other important differences from a beam, such as the club face wall of the present invention being a continuous structure rather than an assembly of beams, the requirement for the ball hitting surface to be an integral part of the structural elements, and the face surface being elliptical in shape, or having other shapes which are used on golf clubs.

FIG. 2 (also prior art) is a downward looking cross section of the face wall of a typical modern prior art "wood" type club head which is made of metal. The face wall, which has a hitting surface 13, has small ribs 14, extending from top to bottom of the face wall, which are integrally formed and intended to improve the strength of the face wall without much increase in face wall mass. The present inventors have shown that the addition of small ribs such as those illustrated in FIG. 2 actually tend to reduce the strength of the face wall if the face wall mass is maintained constant.

U.S. Pat. No. 5,380,010 issued to the present inventors, and U.S. Pat. No. 5,464,211 (C. Atkins), U.S. Pat No. 5,570,886 (Rigal et al), U.S. Pat. No. 4,076,254 (G. Nygren), and U.S. Pat. No. 664,438 all show internal bracing between the inside surface of the face wall and other parts of the club head to provide adequate face strength. In order to maintain total head mass at a desired value, all involve removing peripheral mass and adding at least part of the removed mass at locations nearer to the center of gravity to provide the internal bracing, thus lowering moments of inertia.

U.S. Pat. No. 4,903,781 (D. Allen) shows a honeycomb structure to support the face. It has nominally uniform bending strength.

U.S. Pat. Re. No. 34,925 (J. McKeighen) shows a construction using a face wall which varies in thickness in an opposite sense, with thicker outer portions and a thinner center portion as compared with the present invention. As a result, it actually requires greater face wall mass for adequate strength.

U.S. Pat. No. 5,163,682 (G. Schmidt et al.) describes a face wall structure in which, compared with the center thickness, the face wall is thinner toward the toe or toward the heel, or both. Toward the toe end, it is of constant thickness in the up-down direction. Toward the heel end, there is a thickened region which starts approximately at the face center and runs toward the lower part of the heel end of the face, its purpose being to facilitate the flow of metal into the face wall when the head is cast. The present invention not only uses thickness variation in the toe-heel direction, but also in the up-down direction, and whereas patent '682 specifies the presence of the thickened portion running toward the heel, the present invention does not depend on any such thickened portion running toward the heel. U.S. Pat. Nos. 5,318,300 and 5,474,296, (both to Schmidt et al.) are similar in construction to each other.

SUMMARY OF THE INVENTION

This invention provides for increasing the maximum size of the hitting face of a golf club that is usable by having a structural configuration which allows increased moments of inertia and better optimizing of the location of the center of gravity.

The face wall is made thicker in the central area where bending stresses are greatest and progressively thinner toward the edges of the face, where bending stresses diminish. The face wall remains thick enough near the edges so that shear stresses will not cause failure. In this choice of thickness variations, consideration is given by the present inventors to hits anywhere on the face, not only hits at the face center. Alternately, similar bending strength variation and corresponding mass reduction may be achieved by use of properly designed ribs, a honeycomb structure, or a sandwich structure rather than simple variations of the face wall thickness, wherein such alternate structures do not extend all the way to the edges of the face.

This optimum design includes a center of gravity location which is roughly in the vicinity of the geometric center of the club head and favors location of the mass of the club head as far from this center of gravity as practical.

The term "perimeter weighting" is ordinary terminology commonly used by golfers, and roughly described the need for proper distribution of the mass. In practical designs, all or most of the walls of modern hollow club heads are much thinner than the face wall to allow the face wall to be thicker so as to have adequate strength to resist impact of club head and ball. The additional mass in the face wall from a thick, uniform wall moves somewhat more mass closer to the center of gravity as a necessary design compromise, and in turn, this reduces the most important moments of inertia. Accordingly, it is important to add no more mass to the face wall than necessary.

The scatter of the centers of impact of hits by golfers of various skills has been shown to have a normal statistical distribution as described in some detail in U.S. Pat. No. 5,366,223. All golfers sometimes have hits for which the impact is partly off the face. This problem is much worse for less skilled golfers. These POP hits are probably the worst hits in golf and a large face greatly reduces them, especially for drivers, because a tee is used. For this reason, a large face is very important for a good design, especially for drivers.

The present inventors have also found by extensive mathematical analysis that there exists an optimum combination of values for the center of gravity location, the loft angle, the moments of inertia, and the club head speed. Reducing unnecessary mass in the face facilitates approximating these optimum values.

The present invention uses local values of face wall thickness which provide adequate bending strength in those areas where bending failure would be most likely to happen and adequate shear strength in those areas where shear failure would be most likely to happen. This leads to greater thickness in the central part of the face and lesser thickness in the outer parts of the face wall, where it joins the heel, toe, top and bottom walls. Alternately, appropriately designed sandwich or honeycomb structures, or ribs may be used in place of, or in addition to, varying the thickness of the face wall. In such cases, the dimensions of such alternate structures vary appropriately with distance from the face center, having less mass toward the periphery and satisfying the need for greater bending strength near the center with adequate shear strength near the periphery; and may even shrink away toward the periphery to a simple homogeneous face wall of adequate thickness.

DETAILED DESCRIPTION OF THE PREFERRED EMBODIMENTS

The design of the present invention provides a desired club head mass together with maximum face size, adequate face wall strength, and with maximum moments of inertia of the club head about the center of gravity of the head for any orientation of the axes of the moments of inertia. The moment of inertia about the vertical axis is more important than about other axes.

A consideration in choice of the structure of the face wall of the present invention is that the bending moment per unit width of the face is largest in the vicinity of the center of the face and along a line generally parallel to the largest dimension of the face perimeter (as shown toe-heel). This is because a reasonable approximation for analysis is to model the face structure as a beam extending perpendicular to the largest dimension of the face and considered to span across the shortest dimension of the face. This approximation is reasonable when the face height, (up-down) is substantially smaller than the face width (toe-heel) which is usual with club face designs. This orientation of the modeled beam is much stiffer than a beam which spans the longest dimension and therefore carries the major portion of the impact load. More exact analysis is possible by such methods as finite element analysis, but such analysis would yield generally similar results to the simplified model.

Figure 1:
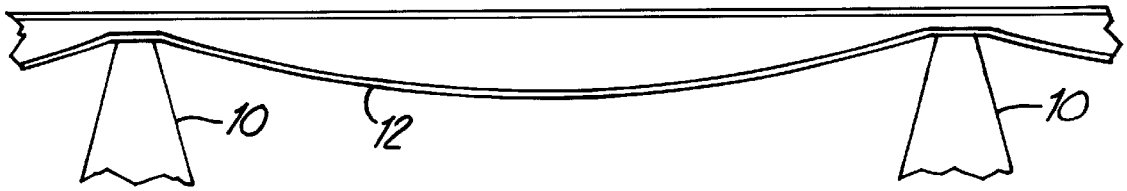
FIG. 1 PRIOR ART
FIG. 1 shows for illustrative purposes a span in one kind of a prior art vehicular bridge which varies in thickness somewhat as in this invention.
Figure 2:
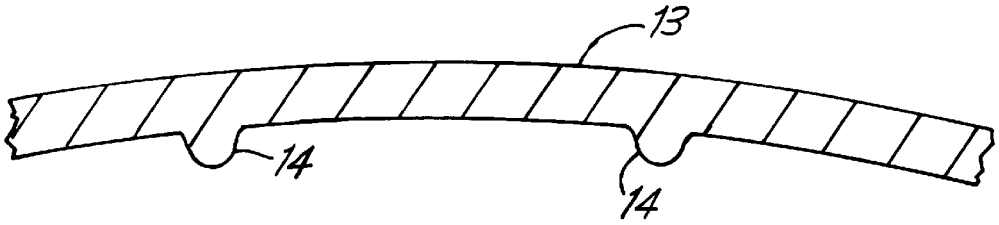
FIG. 2 PRIOR ART
FIG. 2 is a cross sectional view of the face wall portion of a typical prior art driver head, looking downward, and showing small ribs on the inner surface which extend from top to bottom of the face wall.
Figure 3:
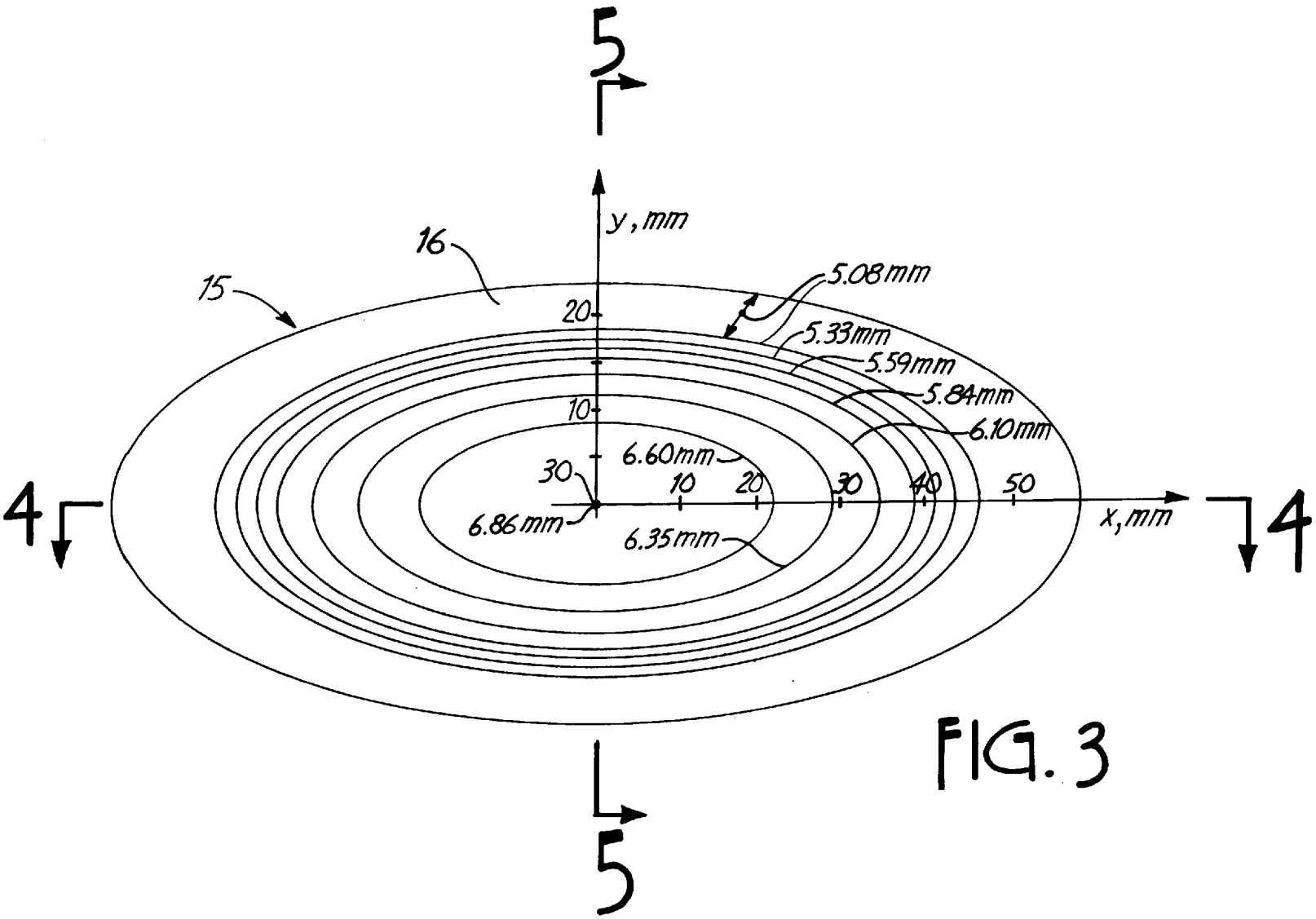
FIG. 3 is an elevation view of a driver face with contour lines representing uniform thicknesses of the face wall to show how face wall thickness varies in an unusually large face driver design embodying the present invention.

FIG. 3 shows calculated optimum thicknesses of the face wall over one representative showing of the face of a driver design having a very large elliptical face perimeter shape when made of 359T6 aluminum. Other materials would have other thicknesses. This face was made as large as practical, consistent with the design goals and limitations explained above. A driver is used by way of example in FIG. 3 because it is a more difficult design problem to realize adequate strength of the face wall as compared with the other clubs. The principles and advantages of this invention apply to other clubs, also. The material of the face wall may be as preferred and may be any structural material such as metal or non-metal. When an alternate structure such as ribs, honeycomb, or sandwich structure is used, such alternate configuration is essentially present in the central zone, and minimal or absent in the outer zone which is illustrated in FIG. 3 as being of constant thickness, because shear strength governs the design of this outer zone.

In FIG. 3, the golf club head is indicated at 15, and the face wall is shown at 16. On the face wall, the center of the face is at the origin point of the graph (the 0—0 point) indicated at 30, and typically, this is shown as having a thickness at the center (See FIG. 4 as well) of 6.86 mm. The general shape of the bulge portion shown at 32 in FIG. 4 is elliptical around its perimeter, and has elliptical contour lines of uniform face wall thickness spaced outwardly from the center essentially as shown.

Here and elsewhere in this discussion "contour lines" is used to describe locations on the face where thickness is constant along such lines.

Figure 4:
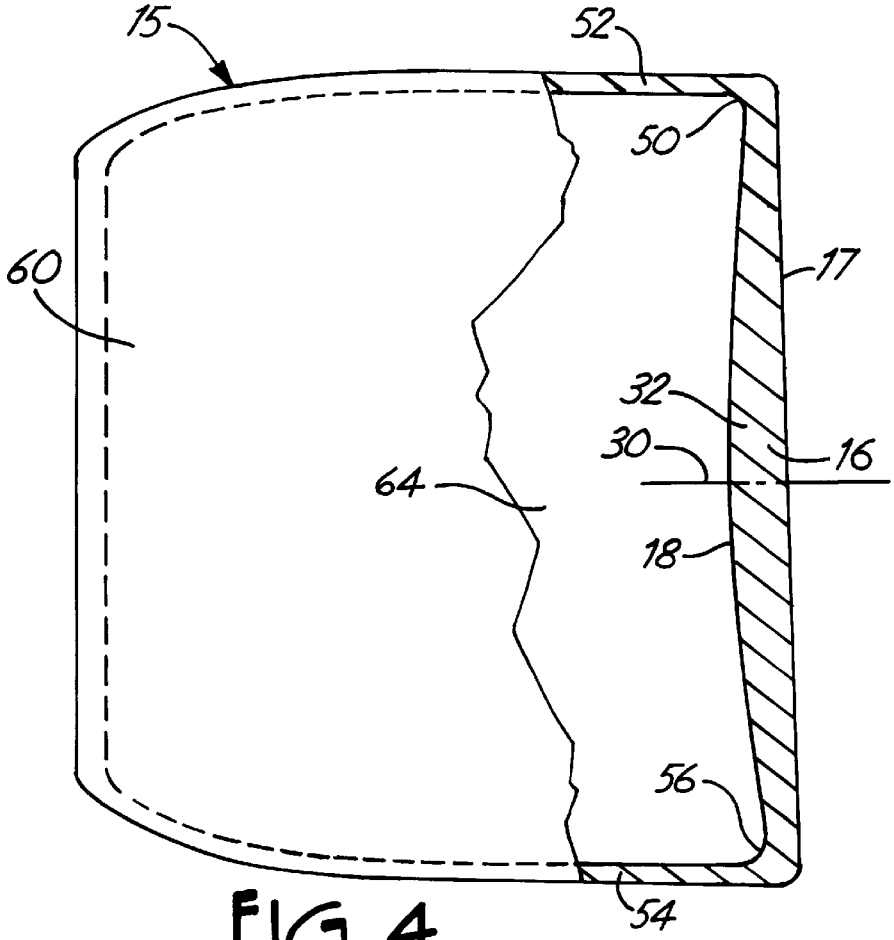
FIG. 4 is a partial cross section of the hitting face, looking downward along lines 4—4 in FIG. 3 and is a representation of a club where there is no curvature of the hitting surface of the club face.

By way of illustration, FIG. 4 shows the shape of the face wall resulting from the use of uniform thickness contour lines having the wall thickness indicated in FIG. 3.

FIG. 4 is a partial horizontal cross sectional view of the face wall shown in FIG. 3 along the line 4—4 in FIG. 3, for the case where the hitting face surface 17 is flat or planar. The inner surface 18 of the face wall 16 is thus curved or bulged to provide the variable thickness perpendicular to the face but with contour lines of uniform thickness around the center as indicated in FIG. 3. The thickness between surfaces 18 and 17 smoothly changes, as shown.

Figure 5:
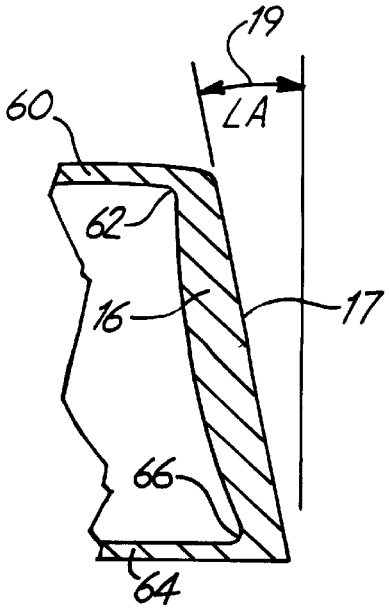
FIG. 5 is a cross section of the face wall taken on line 5—5 in FIG. 3.

FIG. 5 is a fragmentary vertical cross sectional view of the face wall described in FIG. 3 taken along the section line indicated at 5—5. It shows a flat face surface 17 as in FIG. 4. In this view, the loft angle of the club head is shown as "LA" at 19.

The face surface 17 is flat, and the inner surface 18 is smoothly curved between the contour lines of uniform thickness, which again are elliptical as shown in FIG. 3. The face wall 16 joins a top wall 60 at a junction 62 and the face wall 16 joins the club head sole or bottom wall 64 at a junction 66. The top wall 60 and the sole wall 64 also then join and are integrally formed with the heel wall 52 and the toe wall 54 to form a hollow, integral club head shell.

Figure 6:
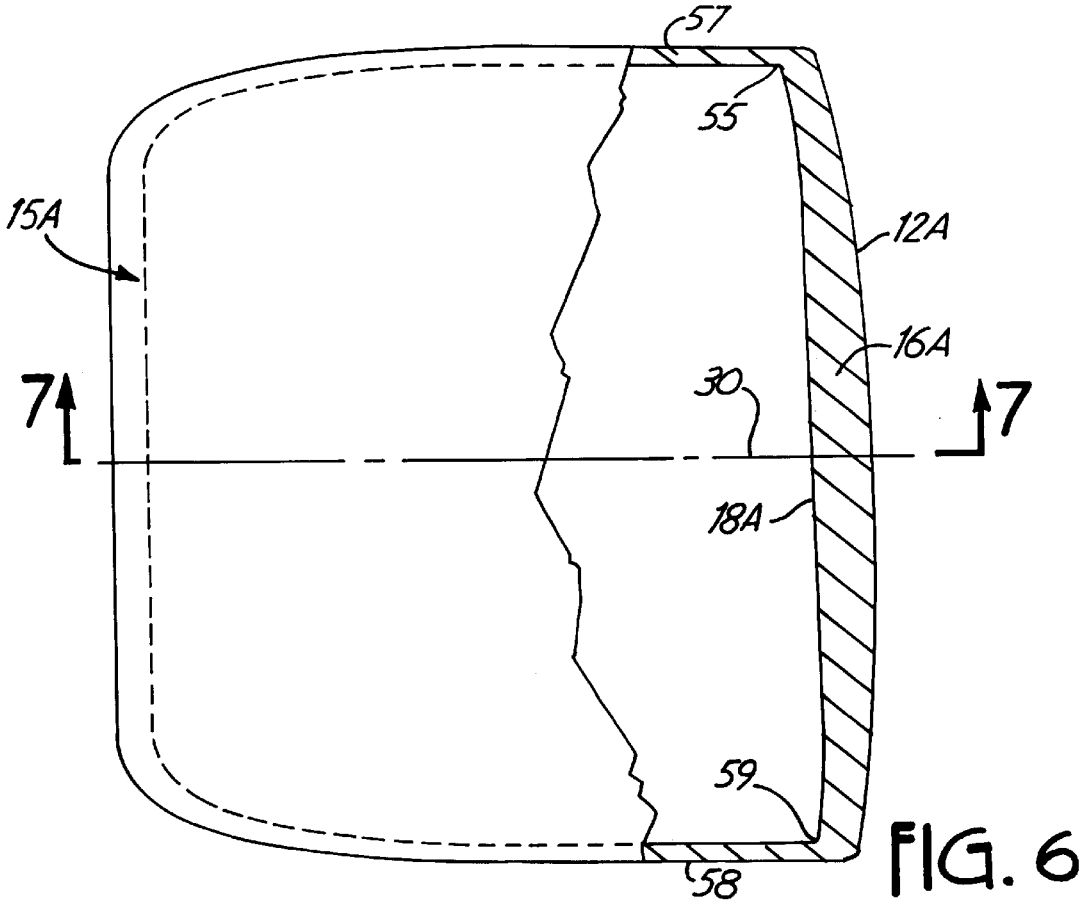
FIG. 6 is a top plan view of a typical golf club head with the face wall sectioned similarly to FIG. 4 and for a club face having typical curvature of its outer surface.
Figure 7:
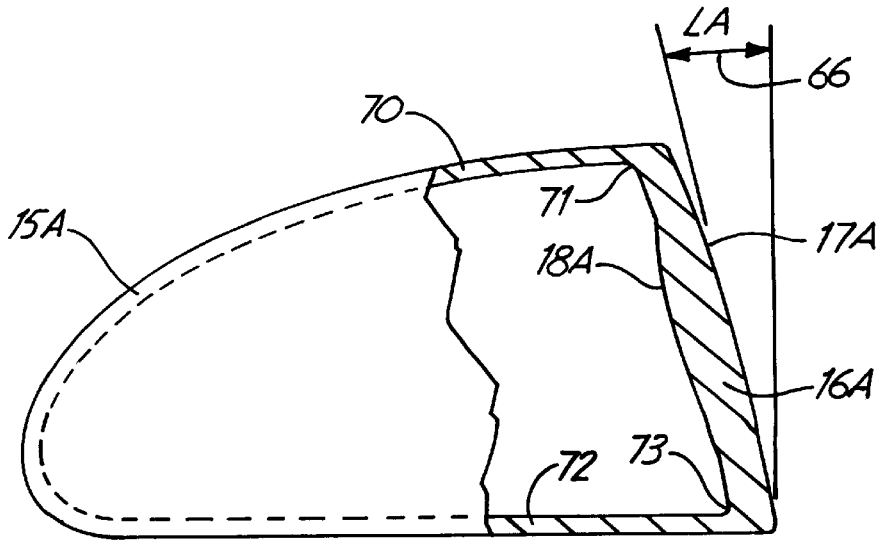
FIG. 7 is a view taken on line 7—7 in FIG. 6 except that it is a club face having typical curvature of its outer surface.
Figure 8:
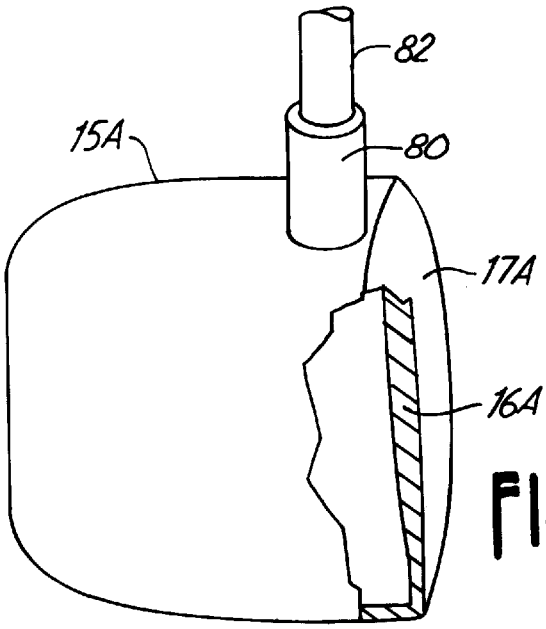
FIG. 8 is a top plan view of the club head of FIG. 7 with part of the top wall broken away.

In practice, there are well-known reasons to use a face that is not flat or planar but is curved as desired for minimizing the errors caused by hits which are somewhat off center. FIGS. 6–8 show the same variations of thickness of a face wall 16A of a club head 15A along elliptical contour lines of uniform thickness as those indicated in FIG. 3, but incorporates a face 17A having a face surface curvature from a heel wall 57 to a toe wall 58. The curvature of the face surface 17A provides most of the variation in face wall 16A thickness so the inside surface 18A has an approximately planar center portion by chance, in this illustration. The face wall 16A joins heel wall 57 at a junction 55, and toe wall 58 at a junction 59.

In FIG. 7, the curved front face surface 17A is illustrated in vertical section. The loft angle LA indicated at 66 is also shown. This shows the same variations in wall thickness as that illustrated in FIG. 3, but again, the curvature of the front face surface 17A alters the rear face 18A, so that in vertical cross section it has a slightly different curvature than wall 18 in FIG. 5.

The face wall 16A joins a top wall 70 at a junction 71, and a sole or bottom wall 72 at a junction 73. The walls are integrally formed at the corners or junctions. The top wall 70 and sole or bottom wall 72 join a heel wall and a toe wall of the club to form the integral hollow head. The face walls 16 and 16A of the two forms are joined only at their peripheral edges to the top, sole, heel and toe walls as can be seen at the corners. The face walls have a uniform thickness adjacent the junctions where they join the shell outer walls.

A hosel 80 is mounted on the club 15A as shown in FIG. 8, and a club shaft 82 can be mounted in the hosel in a conventional manner.

The features described in the present invention are also applicable to club faces having perimeter shapes other than elliptical.

Figure 12:
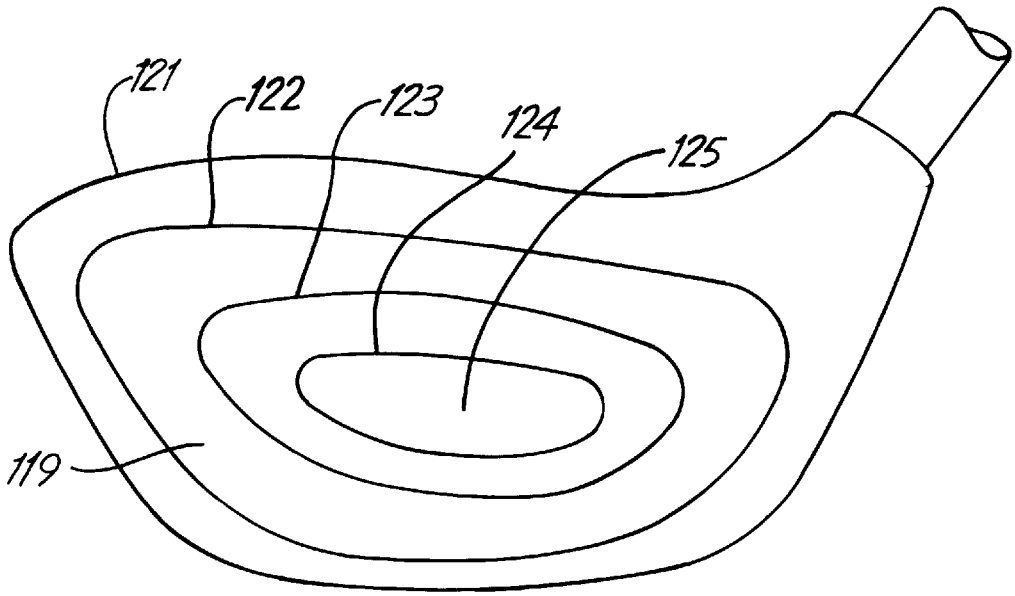
FIG. 12 is similar to FIG. 3, except it is a more conventional face shape.

FIG. 12 shows a conventional golf driver head strike face shape, having a face wall 119 made in accordance with the present invention. The face outline is at 122, the center is at 125, and two of many possible contour lines of equal face wall thickness are indicated at 123 and 124. The face wall thickness would be constant from contour line 123 to the perimeter 122 of the face. The face wall thickness would vary smoothly from the face center through these contour lines, to the perimeter zone of constant thickness. These contour lines and the perimeter area of constant face thickness are similar to the design described above for a club head having an elliptical face as in FIG. 3.

The contour lines for FIG. 12 are shown only to illustrate the case for face perimeter shapes other than elliptical, but were not accurately calculated for this figure. In general, they are not elliptical contour lines as in the case of FIG. 3. The same general design considerations apply to FIG. 12 as were described for FIG. 3.

It is apparent that these variations of face wall thickness eliminate unneeded face mass as compared with a face whose thickness is constant at the maximum required thickness (at the face center). In turn, the mass saved from the face wall can be used elsewhere in the club head which provides more freedom for optimizing the location of the center of gravity and for increasing the moments of inertia. As shown, the center portion adjacent center 30 is at least 10% thicker (as shown, 35% thicker in this example) than the average wall thickness adjacent the peripheral edge.

Figure 9:
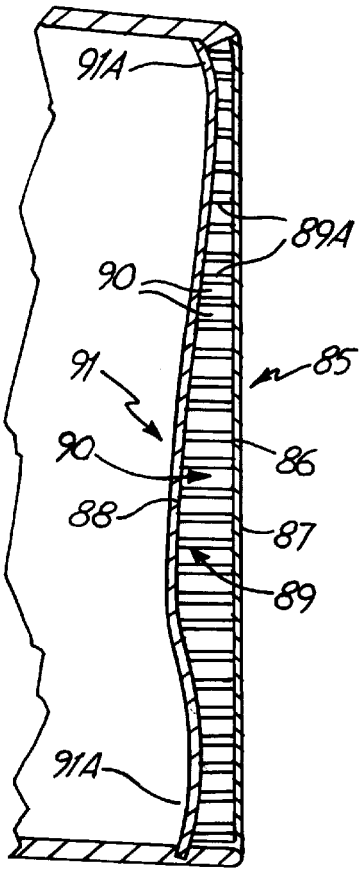
FIG. 9 is a fragmentary sectional view similar to FIG. 4 illustrating a honeycombed construction for the face wall.

Another means of providing adequate strength with minimal mass is use of a sandwich (honeycomb center) structure for the face wall, as shown in FIG. 9, which is a well-known structural configuration. As encompassed by the present invention, it is made appropriately stronger by thicker surface layers or skin and/or greater thickness of the honeycomb in the central portions of the face wall than at the edge portions. The material of the central part of the sandwich between its front and rear surfaces must have adequate compressive strength to withstand the compressive loading of club-ball impact. Further, shear stresses may be difficult for sandwich structures.

Figure 10:
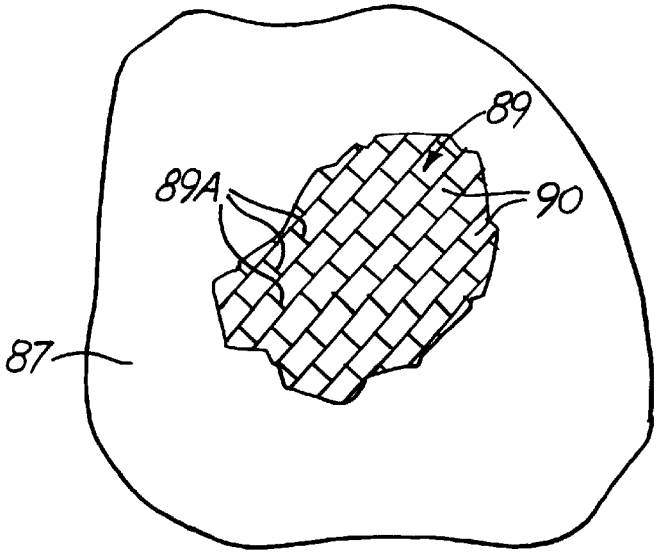
FIG. 10 is a fragmentary front view of the face of the golf club structure shown in FIG. 9 with parts broken away to show interior wall members.

FIG. 9 illustrates a club head 85 that has a honeycomb type construction face wall 86. This honeycomb construction is shown schematically, and includes a front face skin 87 forming the ball strike surface, a rear skin 88, and a honeycomb 89 between the two skins 87 and 88. The honeycomb members are bonded to the skins 87 and 88 in a suitable manner. The honeycomb 89 is a series of structural tubular members formed with walls 89A which surround openings 90, as shown in FIG. 10. As shown, the cross sections of the openings are square or rectangular, or may be of other shape, but generally speaking, the honeycomb openings would be hexagonal. The square cross sections are used for purposes of illustration. The individual walls 89A, as can be seen, are varied in length to permit a bulge portion 91 to be formed in the center portions of the club head. The face skin 87 and the rear skin 88 also can be varied in thickness for changing strength characteristics. The cross-sectional area of honeycomb tubes 90 can be smaller in the center portion, so that there are more support walls to provide greater support between the front and rear skins in the center portions where the maximum loads are encountered.

Figure 11:
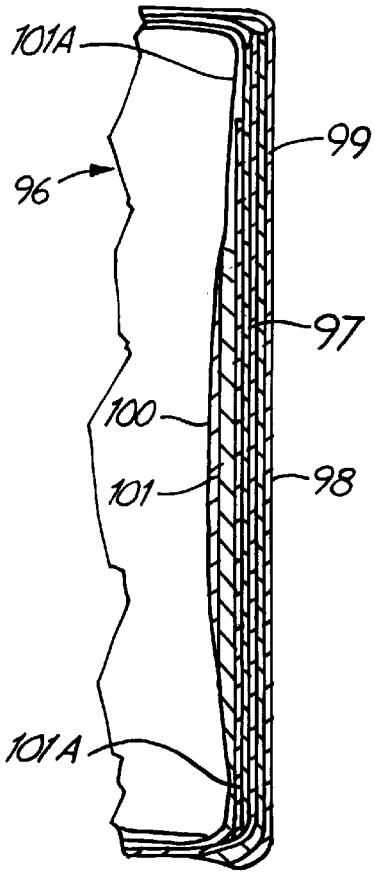
FIG. 11 is a fragmentary sectional view similar to FIG. 4 showing a multi-layered composite face wall.

In FIG. 11, a modified club 96 is illustrated, and it has a face wall 97 with a striking surface 98 on an outer skin layer. The face wall 97 is made up of a plurality of laminate layers 99 that are bonded together to form a sandwich of solid laminate layers forming a solid wall. The face wall 97 is made up of a plurality of individual layers or laminates 99 all bonded together. The rear surface 100 of the laminated face wall, as shown, can be curved for the purposes stated previously, that is, for greater strength without increasing the mass. The walls shown in FIGS. 9, 10 and 11 are modifications of the present invention that provide alternatives to the solid face wall. The wall 97 shown in FIG. 11, is a sandwich type construction that has the outer layers of material with multiple laminates between them all bonded together.

It should be noted that the structures of FIGS. 9 and 10 do not have to be honeycombed or multi-layered all the way out to the supporting heel and toe walls or top and bottom walls. In other words, the center portions shown at 91 and at 101 can be multi-layered, while the outer edge portion shown at 91A and 101A can be a solid plate.

In the honeycomb structure, which is also a sandwich structure, the center portions of the outer face wall can be a light weight filler between the inner and outer skins, and the same can be true with the laminated structure shown in FIG. 11. In FIG. 11, the center laminates that make the bulge between the inner and outer skins can be lightweight materials that are bonded to the inner and outer skins, forming a homogenous structure.

The simplest and presently preferred design is to make the face wall a solid that is thicker in the central portions and thinner in the outer portions as described in FIGS. 3 through 8.

The present invention is intended to encompass adequate bending strength in the central portion of the face by use of thicker face, honeycomb, or sandwich structure, with progressively less bending strength toward the edges of the face, together with such thickness as needed for the shear strength, such that the mass of the face is minimized for the strength of the wall.

Although the present invention has been described with reference to preferred embodiments, workers skilled in the art will recognize that changes may be made in form and detail without departing from the spirit and scope of the invention.

What is claimed is:

1. A face wall for a golf club head, the face wall having a central portion and a peripheral portion surrounding the central portion, the face wall being forced to have greater bending strength per unit of width in the central portion than in the peripheral portion, said face wall being attached to other parts of the golf club head only at a peripheral edge, these other parts of the golf club head having a peripheral shape surrounding the peripheral portion, the face wall having a thickness that is maximum in the central portion and which is substantially non-increasing toward the peripheral edge in substantially all directions along the face wall from the central portion, the peripheral portion being substantially a minimum thickness of the face wall, such that contour lines at the same thickness of the face wall pass around a central axis perpendicular to the face wall and form contour lines generally corresponding to the peripheral shape.

2. The face wall of claim 1, wherein the face wall thickness is formed such that the contour lines are generally elliptical in shape.

3. A face wall structure for a golf club head comprising a face wall having a peripheral edge and a thickness, club head walls supporting said face wall only along the peripheral edge, the face wall formed to have greater bending strength per unit of width in the central portion of the wall than in portions adjacent the peripheral edge, wherein the central portion of the face wall have the greatest thickness, and the face wall portions adjacent the peripheral edge being substantially of minimum thickness, the face wall having generally decreasing thickness in substantially all directions from the central portions to the peripheral edge, said club being free of structural elements connecting an internal surface of said face wall to other portions of the club head, except at the peripheral edge.

4. The face wall of claim 3, wherein the face wall is a homogeneous plate having a hitting surface of desired surface shape and wherein the central portion is at least 10% thicker than the average thickness adjacent the peripheral edge.

5. The face wall of claim 3, wherein the face wall is a solid homogenous plate.

6. The face wall of claim 5, wherein the face wall comprises a multi-layer sandwich structure in at least the central portion.

7. The face wall of claim 5, wherein the face wall comprises a honeycomb sandwich structure in at least the central portion to gain bending strength.

8. The face wall of claim 3, wherein the face wall structure is a homogenous wall having an edge of a ball hitting surface defined by the perimeter, and having a central portion which is at least 10% thicker than the average thickness around the peripheral edge.

9. The face wall of claim 1, wherein the perimeter of the club is elliptical, and the points form elliptical contour lines defining face wall regions of uniform thickness.

10. The face wall of claim 3, wherein said wall is formed of a sandwich structure having an outer face skin, a light weight filler, and an inner skin formed as a homogeneous structure.

11. The face wall of claim 3, wherein an external surface of the face wall is curved.

* * * * *

UNITED STATES PATENT AND TRADEMARK OFFICE

CERTIFICATE OF CORRECTION

PATENT NO. : 6,319,150 B1
DATED : November 20, 2001
INVENTOR(S) : Frank D. Werner et al.

It is certified that error appears in the above-identified patent and that said Letters Patent is hereby corrected as shown below:

Column 7,
Line 23, cancel "forced" and insert -- formed --.

Column 8,
Line 5, cancel "have" and insert -- has --.

Signed and Sealed this

Fourteenth Day of January, 2003

JAMES E. ROGAN
*Director of the United States Patent and Trademark Office*